US005487113A

United States Patent [19]

Mark et al.

[11] Patent Number: 5,487,113

[45] Date of Patent: Jan. 23, 1996

[54] METHOD AND APPARATUS FOR GENERATING AUDIOSPATIAL EFFECTS

[75] Inventors: Steven D. Mark, Newport Beach; David Doleshal, Lido Isle, both of Calif.

[73] Assignee: Spheric Audio Laboratories, Inc., Santa Ana, Calif.

[21] Appl. No.: 151,362

[22] Filed: Nov. 12, 1993

[51] Int. Cl.[6] ..... H04R 3/00

[52] U.S. Cl. ..... 381/17; 381/1

[58] Field of Search ..... 381/17, 1, 73.1, 381/18

[56] References Cited

U.S. PATENT DOCUMENTS

| | | | |
|---|---|---|---|
| 4,063,034 | 12/1977 | Peters | 381/17 |
| 4,393,270 | 7/1983 | Van den berg | 179/1 D |
| 4,748,669 | 5/1988 | Klayman | 381/1 |
| 4,841,572 | 6/1989 | Klayman | 381/17 |
| 4,866,774 | 9/1989 | Klayman | 381/1 |
| 5,095,507 | 3/1992 | Lowe | 381/17 |
| 5,105,462 | 4/1992 | Lowe et al. | 381/17 |
| 5,138,660 | 8/1992 | Lowe et al. | 381/17 |
| 5,144,673 | 9/1992 | Matsumoto et al. | 381/61 |
| 5,208,860 | 5/1993 | Lowe et al. | 381/17 |

FOREIGN PATENT DOCUMENTS

| | | |
|---|---|---|
| 0276159 | 1/1988 | European Pat. Off. . |
| 9113497 | 9/1991 | WIPO . |
| 9120167 | 12/1991 | WIPO . |

OTHER PUBLICATIONS

Sunier, John, "Ears Where the Mikes Are," Part II, Binaural Overview, Audio (Dec. 1989) pp. 49–57.

Hebrank, Jack & Wright, D., "Are two ears necessary for localization of sound sources on the median plane?" J. Acoust. Soc. Am., vol. 56, No. 3 (Sep. 1974) pp. 935–938.

QSound brochure.

Digital Theater Systems brochure.

Kurpzumi, K. et al., "Methods of Controlling Sound Image Distance by Varying the Cross–Correlation Coefficient Between Two–Channel Acoustic Signals," Electronics and Communications in Japan, vol. 68, No. 4, Apr. 1985, New York, pp. 54–63.

*Primary Examiner*—Stephen Brinich
*Attorney, Agent, or Firm*—Irell & Manella

[57] ABSTRACT

A method and apparatus is disclosed for producing one or more audiospatial effects in an original audio signal. A spatially disorienting signal, typically a modified white noise pattern, is combined with the original audio signal. A spatially reorienting signal is further combined with the original audio signal in order to give a listener the perception, upon hearing the original audio signal played back, that the sound emanates from a predetermined direction.

65 Claims, 3 Drawing Sheets

METHOD AND APPARATUS FOR GENERATING AUDIOSPATIAL EFFECTS

FIELD OF THE INVENTION

This invention relates generally to the field of audio reproduction. More specifically, the invention relates to techniques for producing or recreating three-dimensional, binaural-like, audiospatial effects.

BACKGROUND

Binaural (literally meaning "two-eared") sound effects were first discovered in 1881, almost immediately after the introduction of telephone systems. Primitive telephone equipment was used to listen to plays and operas at locations distant from the actual performance. The quality of sound reproduction at that time was not very good, so any trick of microphone placement or headphone arrangement that even slightly improved the quality or realism of the sound was greatly appreciated, and much research was undertaken to determine how best to do this. It was soon discovered that using two telephone microphones, each connected to a separate earphone, produced substantially higher quality sound reproduction than earphones connected to a single microphone, and that placing the two microphones several inches apart improved the effect even more. It was eventually recognized that placing the two microphones at the approximate location of a live listener's ears worked even better. Use of such binaural systems gave a very realistic spatial effect to the electronically reproduced sound that was impossible to create using a single microphone system. Thus, quite early in this century, it was recognized that binaural sound systems could produce a more realistic sense of space than could monaural systems.

However, building a commercially viable audio system that embodies the principles of binaural sound and that actually works well has proven immensely difficult to do. Thus, although the basic method of using in-the-ear microphones has been known for many decades, the method remains commercially impractical. For one thing, even if a recording made by placing small microphones inside one person's ear yields the desired spatial effects when played back on headphones to that same person, the recording does not necessarily yield the same effects when played back for other people, or when played over a loudspeaker system. Moreover, when recording with in-the-ear microphones, the slightest movement by the subject can disturb the recording process. Swallowing, breathing, stomach growls, and body movements of any kind will show up with surprising and distracting high volume in the final recording; because these sounds are conducted through the bone structure of the body and passed on via conduction to the microphones, they have an effect similar to whispering into a microphone at point blank range. Dozens of takes—or more—may be required to get a suitable recording for each track. Attempts have been made to solve these problems by using simulated human heads that are as anatomically correct as possible, but recordings made through such means have generally been less than satisfactory. Among other problems, finding materials that have the exact same sound absorption and reflection properties as human flesh and bone has turned out to be very difficult in practice.

Because binaural recording using in-the-ear microphones or simulated heads is unsatisfactory in practice, various efforts have been made to create binaural-like effects by purely electronic means. However, the factors and variables that make binaural sound rich and three dimensional have proven very difficult to elucidate and isolate, and the debate over these factors and variables continues to this day. For a general discussion of binaural recording techniques, see Sunier J., "A History of Binaural Sound," Audio Magazine, Mar. 1986; and Sunier, J., "Ears where the Mikes Are," Audio Magazine, Nov.-Dec. 1989, which are incorporated herein by this reference.

For example, common "stereo" systems focus on one particular element that helps binaural recording systems add a sense of directionality to otherwise flat monaural sounds: namely, binaural temporal disparity (also known as "binaural delay" or "interaural delay"). Binaural temporal disparity reflects the fact that sounds coming from any point in space will reach one ear sooner than the other. Although this temporal difference is only a few milliseconds in duration, the brain apparently can use this temporal information to help calculate directionality. However, to date, virtually no progress has been made at capturing, in a commercial sound system, the full range of audiospatial cues contained in true binaural recordings. One result is that stereo can only create a sense of movement or directionality on a single plain, whereas a genuine binaural system should reproduce three dimensional audiospatial effects.

It has been theorized that the dramatic audiospatial effects sometimes produced using binaural, in-the-ear recording methods are due to the fact that the human cranium, pinna, and different parts of the auditory canal serve as a set of frequency selective attenuators, and sounds coming from various directions interact with these structures in various ways. For example, for sounds that originate from directly in front of a listener, the auditory system may selectively filter (i.e., attenuate) frequencies near the 16,000 Hz region of the audio power spectrum, while for sounds coming from above the listener, frequencies of around 8,000 Hz may be substantially attenuated. Accordingly, it has been theorized that the brain figures out where a sound is coming from by paying attention to the differential pattern of attenuations: thus, if the brain hears a sound conspicuously lacking in frequencies near 16,000 Hz, it "guesses" that the sound is coming from in front of the listener. See generally, U.S. Pat. No. 4,393,270; Blauert, J., *Spatial Hearing: The Psychophysics of Human Sound*, MIT Press, 1983 (incorporated herein by this reference); Hebrank, J.H. and Wright, D., "Are Two Ears necessary for Localization of Sounds on the Median Plane?", *J. Acoust. Soc. Am.*, 1974, Vol. 56, pp. 935–938; and Hartley, R. V. L. and Frys, T. C., "The Binaural Localization of Pure Tones," *Phys. Rev.*, 1921, 2d series, Vol. 18, pp. 431–442.

A number of audio systems attempt to electronically simulate binaural audiospatial effects based on this model, and use notch filters to selectively decrease the amplitude of (i.e., attenuate) the original audio signal in a very narrow band of the audio spectrum. See, for example, U.S. Pat. No. 4,393,270. Such systems are relatively easy to implement, but generally have proven to be of very limited effectiveness. At best, the three dimensional effect produced by such devices is weak, and must be listened to very intently to be perceived. The idea of selective attenuation apparently has some merit, but trying to mimic selective attenuation by the straightforward use of notch filters is clearly not a satisfactory solution.

In sum, binaural recording and related audiospatial effects have remained largely a scientific curiosity for over a century. Even recent efforts to synthetically produce "surround sound" or other binaural types of sound effects (e.g., Hughes Sound Retrieval®, Qsound®, and Spatializer®)

generally yield disappointing results: three dimensional audiospatial effects are typically degraded to the point where they are difficult for the average person to detect, if not lost entirely. As desirable as binaural sound effects are, a practical means to capture their essence in a manner that allows such effects to be used in ordinary movie soundtracks, record albums or other electronic audio systems has remained elusive.

Accordingly, a basic objective of the present invention is to provide means for producing realistic, easily perceived, three dimensional, audiospatial effects. Further objectives of the present invention include producing such audiospatial effects in a manner that can be conveniently integrated with movie soundtracks, recording media, live sound performances, and other commercial electronic audio applications.

SUMMARY OF THE INVENTION

The present invention solves the problem of how to produce three dimensional sound effects by a novel approach that confronts the human auditory system with spatially disorienting stimuli, so that the human mind's spatial conclusions (i.e., its sense of "where a sound is coming from") can be shaped by artificially introduced spatial cues. Accordingly, in the preferred embodiment of the invention, a spatially disorienting background sound pattern is added to the underlying, original audio signal. This disorienting background sound preferably takes the form of a "grey noise" template, as will be discussed in greater detail below. Spatially reorienting cues are also included within (or superimposed upon) the grey noise template, such that the human auditory system is led to perceive the desired audiospatial effects. Preferably, these reorienting spatial cues are provided by frequency-specific "notches" and/or "spikes" in the amplitude of the grey noise template.

In a further embodiment of the present invention, a grey noise template is generated which contains both disorienting grey noise and reorienting signals. The template can then be added as desired to the original audio signal.

In one preferred embodiment, the methodology of the present invention is applied to the production of three dimensional audiospatial effects in movie soundtracks or other sound recording media. In yet another preferred embodiment, the methodology of the present invention is applied to create three dimensional audiospatial effects for live concerts or other live performances.

DETAILED DESCRIPTION OF THE PREFERRED EMBODIMENTS

Figure 1:
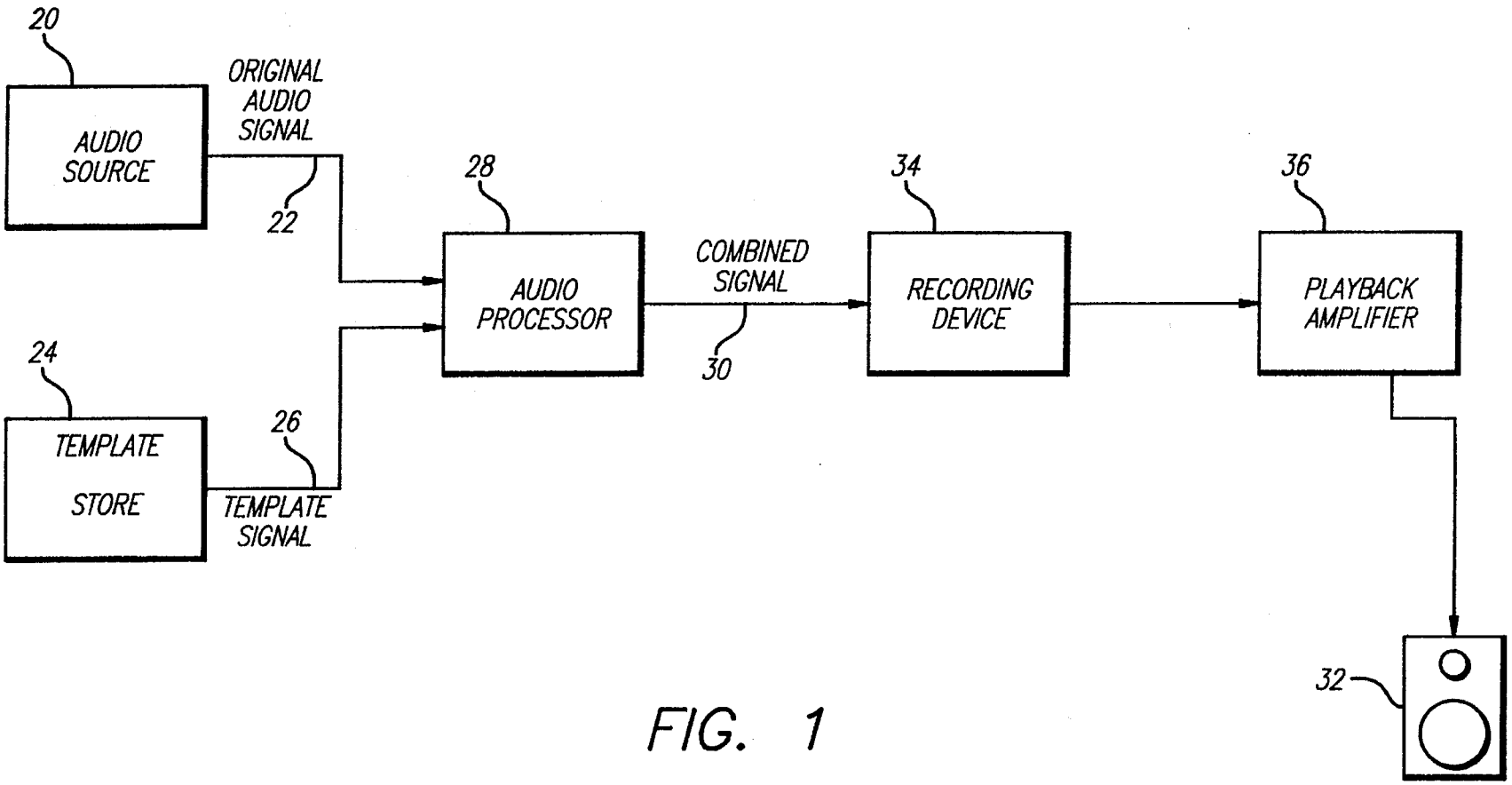
FIG. 1 is a block diagram of an audio processing system that implements one embodiment of the present invention.

In the preferred embodiment of the present invention, a spatially disorienting background sound pattern (a "template") is added to an underlying, original audio signal. Spatially reorienting cues are also included within the template, such that the human auditory system is led to perceive the desired audiospatial effects. FIG. 1 illustrates one architecture that may be used to practice this invention. An original audio signal 22, such as a recorded musical performance, motion picture soundtrack, is produced by an audio source 20, which can be any recording or sound generating medium (e.g., a compact disc system, magnetic tape, or computer synthesized sounds such as from a computer game). Template signal 26 (which contains both disorienting and reorienting spatial cues, as described in much greater detail below) is obtained from template store 24, which may take the form of a magnetic tape, a library stored on a CD-ROM, data on a computer hard disk, etc.

In order to lend three dimensional sound effects to audio signal 22, template signal 26 and audio signal 22 are combined (i.e., summed together) by an audio processor 28, which may be a conventional sound mixer (a Pyramid 6700 mixer was used successfully in the preferred embodiment). Alternatively, a digital audio processor can be used to make this combination, which may be useful if further signal processing is desired, as described below. In practice, we find it is convenient to transfer template signal 26 and audio signal 22 to separate tracks of a multi-track tape recorder, such as a DigiTec model 8-70A 8-track recorder, and to mix from the outputs of the recorder. This simplifies the task of synchronizing the spatial cues to the desired portions of the original audio signal, and also allows for more complex mixes.

Resulting combined signal 30 may be passed to recording device 34, which can be a magnetic tape recorder, compact disc recorder, computer memory, etc., for storage and later playback. Alternatively, combined signal 30 may be passed for immediate listening to an audio output system such as amplifier 36 and loudspeaker 32. The resulting audio output is perceived by listeners as possessing the desired three dimensional effects. As discussed further below, this illustrative apparatus represents just one of many practical applications that are within the scope of the present invention.

In the preferred embodiment, "grey noise" serves as the constant, spatially disorienting signal within the template. As is well-known in the art, white noise is a sound that is synthetically created by randomly mixing roughly equal amounts of all audible sound frequencies 20 HZ to 20,000 HZ; when listened to alone, white noise resembles a hissing sound. What we refer to here as "grey noise" is similar to white noise, except that it contains a slightly higher percentage of lower frequencies. We have experimentally determined that grey noise templates seem to produce superior audiospatial effects than do white noise templates, in the context of the present invention. Although there are many possible compositions for grey noise, through our experimentation we have found that a mix approximating the following breakdown seems to work best (all values assume that "Z" is the amplitude of an equivalent bandwidth of white noise of the same volume):

TABLE I

| GREY NOISE MIX | |
|---|---|
| Frequency Band | Amplitude |
| 20,000–16,000 Hz | Z × .82 |
| 15,999–8,600 Hz | Z × .85 |
| 8,599–6,550 Hz | Z × .92 |

TABLE I-continued

| GREY NOISE MIX | |
|---|---|
| Frequency Band | Amplitude |
| 6,549–4,000 Hz | Z × .99 |
| 3,999–1,800 Hz | Z × 1.1 |
| 1,799–800 Hz | Z × 1.2 |
| 799–400 Hz | Z × 1.3 |
| 100–20 Hz | Z × 1.35 |

For maximal effect, this grey noise background signal should be added for a minimum of about 2 seconds prior to the onset of each spatially reorienting cue, and should continue for about 0.5 seconds or more following the cessation of each such cue.

In addition to the constant "disorienting signal", the preferred embodiment of the present invention also calls for one or more reorienting spatial cures, also referred to as a "reorienting signal". In the preferred embodiment, reorienting signals are incorporated within the grey noise template; equivalently, they could be separately added to the original audio signal, if desired. The pattern of these reorienting signals is more complex than the constant grey noise background, in that these signals are preferably time varying, and differ depending on the particular audiospatial effect that one desires to create.

Figure 2:
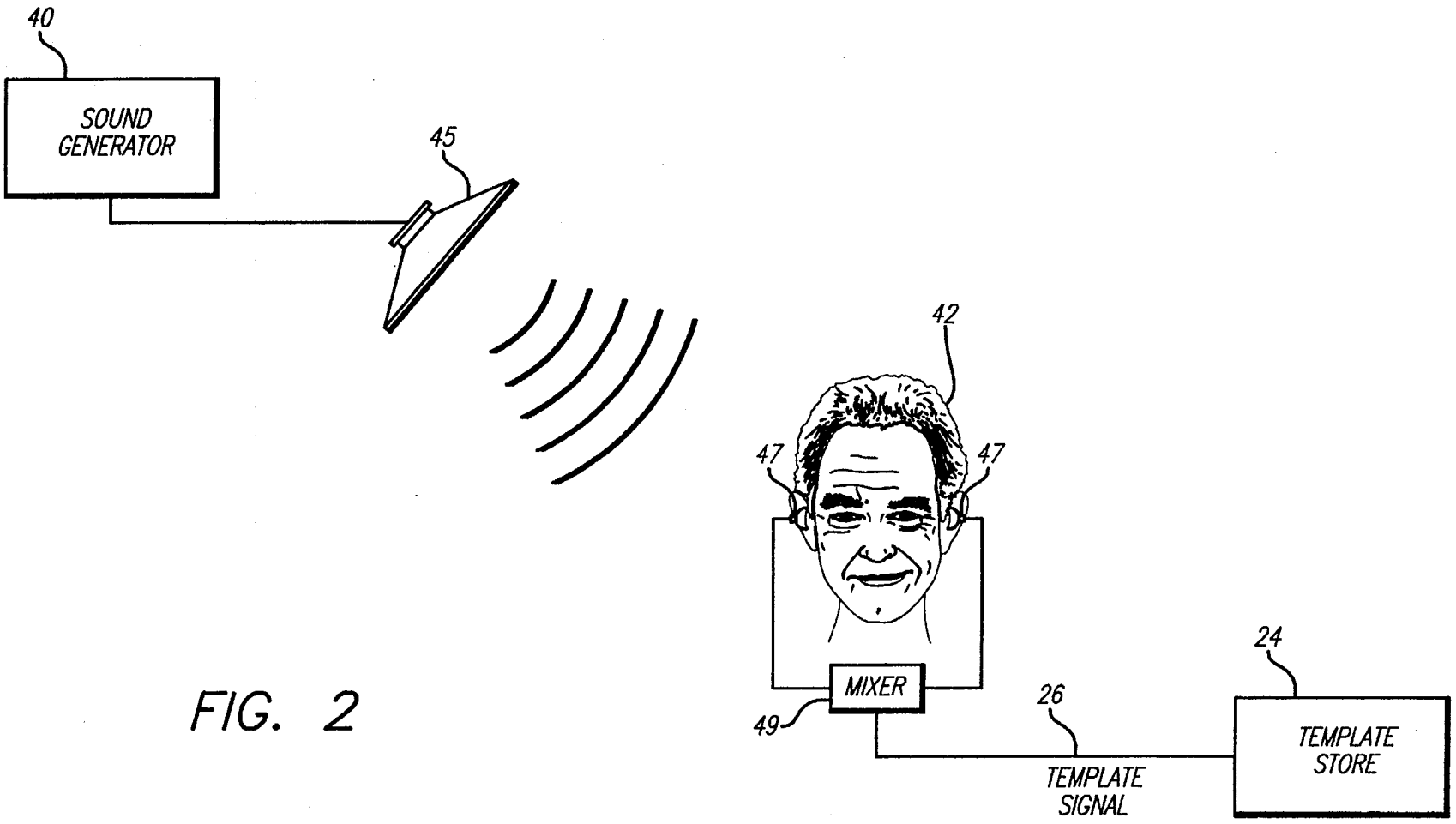
FIG. 2 illustrates one technique for generating grey noise templates for use with the present invention.

FIG. 2 illustrates one way to generate grey noise templates having the desired "disorienting" and "reorienting" properties. In FIG. 2, sound generator 40 is an ordinary, programmable sound generator, familiar to those of skill in the art, coupled, though an amplifier if necessary, to a full-range speaker 45. Sound generator 40 is programmed to generate grey noise as described in Table I above. The signal generator included in the Techtronics 2642A Fourier analyzer, coupled to a simple full-range speaker (such as Radio Shock's Realistic® Minimus-77 speaker), has so far been found to be best suited for these purposes. Alternatively, a standard white noise generator could be used along with a narrow band, high quality digital equalizer (such as a Sabine FBX 1200) to provide the required emphasis and deemphasis of frequency bands as described in Table I. Those of skill in the art will appreciate that many other such noise generators and speakers are available and can provide comparable results. Preferably, the generated white noise should be of a highly random quality. In many instances, it may be useful to record the output of sound generator 40 for later playback through speaker 45, rather than couple speaker 45 directly to sound generator 40.

Recording subject 42 is preferably an individual with normal hearing, who has a small microphone 47 inserted into each of his two ear canals. Small crystal lapel microphones, such as Sennheiser® microphones, generally work the best. In order to generate a template that will produce a desired audiospatial effect, sound generator 40 is activated and speaker 45 is placed in a location relative to recording subject 42 (e.g., below, above, behind, or in front of the subject's head, etc.) that corresponds to the particular three dimensional effect that is desired. In addition, if a sense of motion from one location in space to another is desired, speaker 45 is moved along a corresponding trajectory. The signal from microphones 47 are combined using a standard mixer 49, to produce template signal 26. Template signal 26 is stored for later playback using template store 24, which is a conventional tape recorder or other recording device.

When template signal 26 is combined with a target original audio signal, as previously discussed in connection with FIG. 1, a three dimensional effect is created: the spatial relationship between sound generator speaker 45 and recording subject 42 is reproduced as a perceptible spatial effect for the target audio signal. For instance, if a recording of a singer is combined with a grey noise template of a frontally placed grey noise generator, the singer will seem to be in front of the listener. Similarly, if the recording of the singer is combined with a grey noise template recorded with a grey noise generator located above and to the rear of a listener, the resulting music will seem to come from above and slightly behind the listener.

While the approach of FIG. 2 is a helpful illustration, in the preferred embodiment of the present invention it is not necessary to actually use in-the-ear binaural microphones in order to generate templates. Instead, digital audio processing equipment easily can be used to synthetically generate such templates from scratch. The power spectrum of successful templates that have already been created using the approach of FIG. 2 reveals the specific audiospatial cues that characterize such templates. One can then simply synthesize a replica of a grey noise template by starting with a "blank" grey noise template (i.e., several seconds of recorded grey noise that matches the profile presented earlier in table I), and then, using a set of peak-notch filters, a frequency equalizer, or similar computerized audio waveform manipulation devices, "sculpt" the blank grey noise template so as to match the pattern of attenuations and augmentations that are displayed in the binaurally recorded grey noise template.

In the preferred embodiment, such synthetic templates are produced using a conventional digital computer with a sound board installed. Specifically, an IBM-PC® compatible '486 computer system equipped with a Capabyra® digital audio processor and the Kyma® software system, manufactured by Symbolic Sound Corporation of Champagne, Illinois, has been found to work well. The accompanying Kyma® software includes a waveform editor and related utilities that permit shaping and tailoring the template signals. The waveforms generated using the system can be stored on a hard disk drive or optical disk drive connected to the computer system. When playback is desired, the system includes output jacks that provide a conventional analog audio signal which can be routed to other devices for further processing or recording. Of course, those of skill in the art will recognized that many other digital signal processing devices exist which are equally well-suited to the tasks described herein. Preferably, such devices should be very low in harmonic distortion.

A synthetically created grey noise template will work just as well as the corresponding template of FIG. 2 (if not better, as discussed further below), and is free of the potentially awkward requirements of "in-the-ear" binaural recording that characterize the approach of FIG. 2.

In yet another preferred embodiment, grey noise templates can be synthetically produced that do not merely mimic the binaurally recorded templates described in connection with FIG. 2, but rather produce effects that are even cleaner and more impressive. For example, one can create a synthetic grey noise template that does not simply mimic the power spectrum profile of augmentation and attenuation that is observed in a binaurally recorded template (prepared in as per FIG. 2), but that instead drastically exaggerates the contours of that profile, in order to emphasize the audiospatial cues. This approach often yields audiospatial effects that are more dramatic than the corresponding effects produced through binaural recording in accordance with FIG. 2.

Designing a specific power spectrum profile to achieve desired audiospatial effect largely is a matter of subjective judgment by the audio engineer as to what combination of augmentation and attenuation sounds best. Just as there is no absolute "right way" to create a musical composition, the creation of audiospatial effects using the present invention also is a matter of individual taste. Nevertheless, through our experiments with many different grey noise templates, we have reached some conclusions regarding preferred techniques for synthesizing grey noise templates that are intended to produce particular audiospatial effects. We describe these conclusions below.

The portion of the audio power spectrum in which a cue is placed determines which type of audiospatial effect will be experienced by listeners. In other words, the same pattern—such as a notch or a spike—yields different audiospatial effects when overlaid on different portions of the power spectrum. Table II lists some specific audiospatial effects that we have studied, along with the corresponding frequencies in which reorienting cues should be placed in order to obtain the listed effect.

TABLE II

| | |
|---|---|
| Coronal: | 8,000 Hz, 500 Hz |
| Frontal: | 16,000 Hz, 2,000 Hz, 200 Hz |
| Posterior: | 10,000 Hz, 1,000 Hz |
| Proximity: | 9,000 Hz, 9,500 Hz |

There will be some effect if a cue is placed in even one of the designated portions of the power spectrum. However, the quality of the effect will be greatly enhanced if cues are properly placed in all relevant regions.

Figure 3:
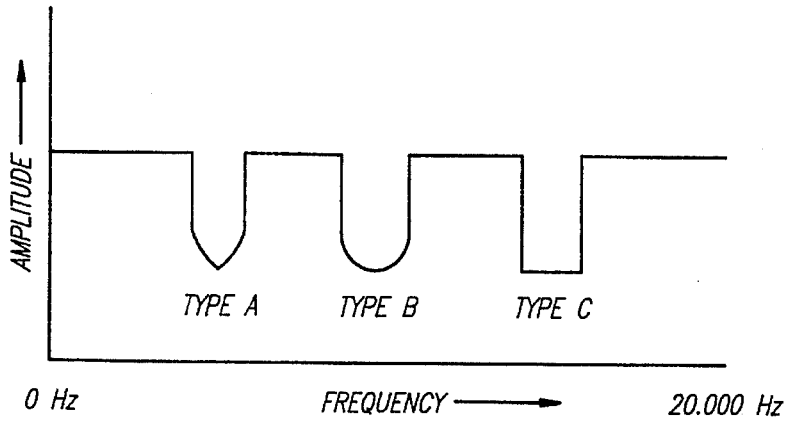
FIG. 3 is a graph of amplitude versus frequency that depicts the shapes of various waveform notches.

In one embodiment of the present invention, spatially reorienting cues can take the form of frequency-specific gaps, or "notches", in the grey noise template. Referring now to FIG. 3, most previous efforts (e.g., along the lines of the "selective attenuation" prior art approach discussed in the Background section) have focussed on notches with a rounded or square waveform, depicted as "Type B" and "Type C", respectively, in FIG. 3. However, we have experimented with notches of many different shapes, and find that of all notch types tested, square notches are the least effective. Instead, we find that notches with the pointed shape depicted as "Type A" are most effective with proximity cues and coronal cues, while notches with the rounded shape depicted as "Type B" are better for lateral, frontal and posterior cues.

Figure 4:
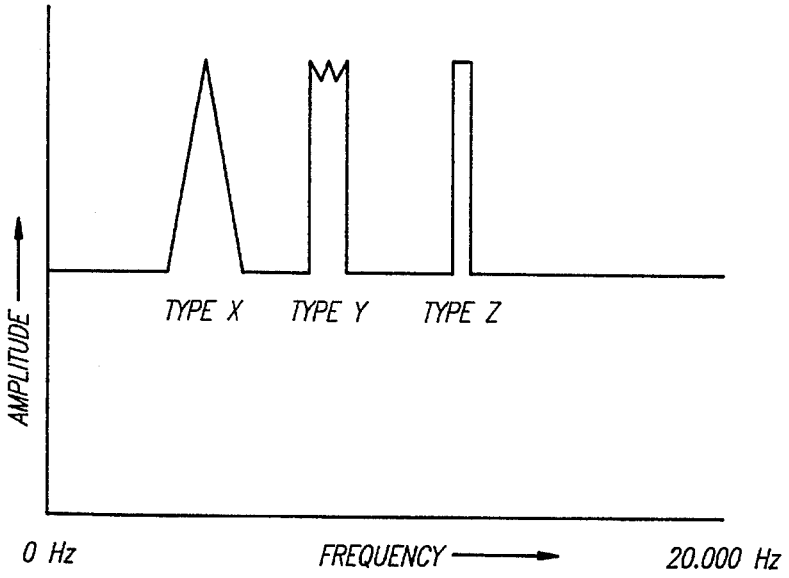
FIG. 4 is a graph of amplitude versus frequency that depicts the shapes of various waveform spikes.

In another embodiment of the present invention, spatially reorienting cues can take the form of frequency-specific augmentations, or "spikes", in the grey noise template. Referring now to FIG. 4, spikes may take several specific shapes. Through our experimental work, we find that triangular spikes (depicted as Type X in FIG. 4) are best for coronal cues or proximity cues; crested spikes (depicted as Type Y) are best for frontal cues; and rectangular spikes (depicted as Type Z) are better for posterior cues, and in any type of cue in which rapid motion is involved. Variations in the shape of the "crest" of Type Y are possible.

Figure 5:
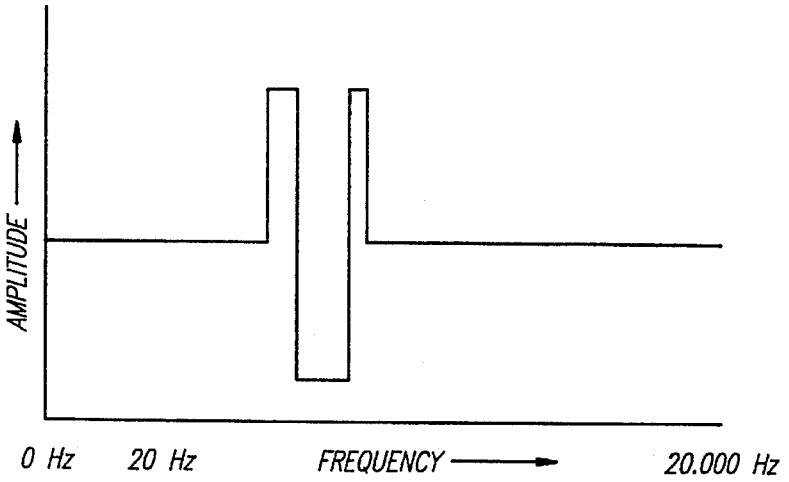
FIG. 5 is a graph of amplitude versus frequency that illustrates a preferred reorienting signal as a combination of two spikes and a notch.

Furthermore, we have experimentally found that maximal effectiveness in spatial reorientation is achieved when a notch is bracketed by a set of spikes, as depicted in FIG. 5. This appears to be a result of the fact that in the human auditory system, unlike most electronic sensing systems, when a sound is presented at a particular frequency, sound-sensing cells sensitive to that frequency are highly stimulated, while cells sensitive to neighboring frequencies are inhibited. This effect, known as "lateral inhibition," plays an important role in human perception of sounds. See generally Von Bekesy, G., *Sensory Inhibition*, Princeton University Press, 1967; Nabet, B. and Pinter, R., *Sensory Neural Networks: Lateral Inhibition*, CRC Press, 1991, which are incorporated herein by this reference. Accordingly, in instances where a spike, rather than a notch, is used as the principal spatial cue, the quality of the three-dimensional effect still is enhanced if the spike is bracketed by a set of adjacent notches, to take advantage of the lateral inhibition effect.

The above findings regarding the bracketing of spikes with notches and vice versa hold true regardless of the specific shape being used for the spikes and notches (which should best be determined by reference to the preceding discussion regarding FIGS. 3 and 4), and is true regardless of which part of the audio frequency spectrum the cue is placed (which should best be determined by reference to the preceding discussion regarding Table II).

Experimental results further suggest that when creating a grey noise template, the "K" of the grey noise template (where "K" is defined as the background amplitude of the template, and not the amplitude of the spikes or notches) should preferably be kept between about 68 to about 78 percent of the "M factor" (where "M factor" is defined as set forth immediately below) of the program material (original audio signal 22). Ideally, this relationship should be maintained in real time as the M factor of the program material varies. "M factor" is defined here by the following table of equations:

TABLE III

DEFINITION OF M FACTOR $$M = \frac{(Z_1 \cdot 20) + (Z_2 \cdot 10) + (Z_3 \cdot 7) + (Z_4 \cdot 4)}{40}$$

$Z_1$ = The volume (in dB) of bandwidth comprised of the frequencies that are 1,000 Hz above or below the frequency the cue is centered upon.

$Z_2$ = The volume (in dB) of bandwidth consisting of all frequencies more than 1,000 Hz above or below the frequency the cue is centered upon, but less than 4,000 Hz above or below this center frequency.

$Z_3$ = The volume (in dB) of the bandwidth consisting of all frequencies more than 4,000 Hz above or below the freqeuncy the cue is centered upon, but less than 10,000 Hz above or below the frequency the cue is centered upon.

$Z_4$ = The volume (in dB) of the bandwidth consisting of all frequencies more than 10,000 Hz above or below the frequency the cue is centered upon.

Moreover, in the creation of notches and spikes, the mathematical formulae set forth in Table IV should preferably be observed, although trial and error may in some cases suggest altering these parameters somewhat from their idealized values.

TABLE IV

FORMULAE FOR NOTCHES AND SPIKES $$W = \frac{2\pi f(.08)}{7}$$

$$C = W\left(\frac{1}{\sqrt{\pi + \frac{M}{\pi}}}\right)$$

$$H = \frac{13.7\sqrt{M}}{\pi}$$

$$D = .05\,(M)$$

where the following additional definitions apply:

W=Width (in Hz) of a notch at its baseline; "baseline" is defined as the point where the notch intersects with K, the amplitude of the grey noise template.

C=Width (in Hz) of spike at baseline; "baseline" is defined as the point where the spike intersects with K.

H=The amplitude (in dB) of a spike. This ratio should also vary in real time as the value of M changes. Note that H is measured and calculated as a specific fraction of M.

D=The depth (in dB) of a notch. This ratio should also vary in real time as the value of M changes. Note that D is measured and calculated as a specific fraction of M.

It will be appreciated that the present invention is extremely useful in a variety of different audio applications. For example, grey noise templates containing the desired audiospatial effects can be overlaid onto a pre-recorded version (on any standard medium) of an original audio signal, or applied to a "live" signal, such as a live performance or computer synthesized sounds (e.g., from a computer game). Furthermore, this procedure can be performed individually for each separate track of a multiple track recording, using a different template for each track if desired. For instance, the lead singer's voice can be given an apparent location in front of the listener by superimposing a frontally reorienting template upon the lead singer track, while the backup singers can be given an apparent location behind the listener by superimposing a rear-wise reorienting template onto the backup singers' track.

In another preferred embodiment, a prerecorded "library" of grey noise templates containing specific sound effects (e.g., behind, above, or below the listener; a slow clockwise motion around the head at a particular distance from the listener; etc.) can be assembled and stored, so that a mixing engineer can conveniently select particular templates from the library as needed for each desired effect.

It will further be recognized that the method of the present invention allows movie sound tracks to be enhanced with three dimensional sound effects, either in their entirety or simply at specific points where deemed desirable. It will similarly be recognized that these same grey noise templates can even be introduced at will into live sound performances.

In addition, it should be further noted that by applying the rules for shaping and placement of notches and spikes described above, one can even provide a noticeable improvement in the quality of audiospatial effects generated using prior art systems. As discussed above, in such prior art systems, the notches and spikes would be applied directly to the original audio signal itself, rather than to the spatially disorienting signal of the present invention.

It is to be further understood that various modifications could be made to the illustrative embodiments provided herein without departing from the scope of the present invention. Accordingly, the invention is not to be limited except as by the appended claims.

What is claimed is:

1. A method for producing one or more desired three-dimensional audiospatial effects in an original audio signal, said method comprising the steps of:

generating a noise signal having one or more amplitude variations introduced at selected frequencies, said frequencies and amplitude variations being selected so as to yield the desired three-dimensional audiospatial effects; and applying said noise signal to said original audio signal, thereby producing the desired three-dimensional audiospatial effects.

2. The method of claim 1, wherein said noise signal comprises a modified white noise signal.

3. The method of claim 2, wherein said modified white noise signal comprises a white noise pattern in which frequencies below about 4,000 Hz are emphasized.

4. The method of claim 2, wherein said modified white noise signal comprises a white noise pattern in which frequencies above about 4,000 Hz are deemphasized.

5. The method of claim 1, wherein said amplitude variations comprise one or more amplitude spikes in said noise signal.

6. The method of claim 1, wherein said amplitude variations comprise one or more amplitude notches in said noise signal.

7. The method of claim 1, wherein said amplitude variations comprise a first amplitude spike in said noise signal, an amplitude notch adjacent (in frequency) to said first amplitude spike, and a second amplitude spike, adjacent (in frequency) to said amplitude notch.

8. The method of claim 1, wherein said amplitude variations comprise a first amplitude notch in said noise signal, an amplitude spike adjacent (in frequency) to said first amplitude notch, and a second amplitude notch, adjacent (in frequency) to said amplitude spike.

9. The method of claim 1, wherein no amplitude variations are introduced during about the first 2 seconds of said noise signal.

10. The method of claim 1, wherein said noise signal continues for at least about 0.5 seconds after the last amplitude variation introduced therein.

11. The method of claim 1, wherein said noise signal is generated using a digital audio processing apparatus.

12. The method of claim 1, wherein said step of applying said noise signal to said original audio signal is accomplished using a digital audio processing apparatus.

13. The method of claim 1, wherein said original audio signal comprises any portion of a pre-existing audio recording.

14. The method of claim 1, wherein said original audio signal comprises any portion of a motion picture soundtrack.

15. The method of claim 1, wherein said original audio signal comprises electronically synthesized sounds.

16. The method of claim 1, wherein said original audio signal comprises any portion of a live sound performance, and wherein said applying said noise signal to said original audio signal occurs during said live sound performance.

17. A method for producing audiospatial effects in an original audio signal, said method comprising the steps of:

combining a spatially disorienting stimulus signal comprising a noise signal with said original audio signal; and combining a spatially reorienting stimulus signal with said original audio signal during a period in which said spatially disorienting stimulus signal is present.

18. The method of claim 17, wherein said spatially disorienting stimulus signal and said spatially reorienting stimulus signal are components of a single signal.

19. The method of claim 17, wherein said noise signal comprises a modified white noise signal.

20. The method of claim 19, wherein said modified white noise signal comprises a white noise pattern in which frequencies below about 4,000 Hz are emphasized.

21. The method of claim 19, wherein said modified white noise signal comprises a white noise pattern in which frequencies above about 4,000 Hz are deemphasized.

22. The method of claim 17, wherein said spatially reorienting stimulus signal comprises a noise signal having one or more amplitude variations introduced at selected frequencies.

23. The method of claim 22, wherein said amplitude variations include one or more amplitude spikes.

24. The method of claim 22, wherein said amplitude variations include one or more amplitude notches.

25. The method of claim 22, wherein said amplitude variations comprise a first amplitude spike in said noise signal, an amplitude notch adjacent (in frequency) to said first amplitude spike, and a second amplitude spike, adjacent (in frequency) to said amplitude notch.

26. The method of claim 22, wherein said amplitude variations comprise a first amplitude notch in said noise signal, an amplitude spike adjacent (in frequency) to said first amplitude notch, and a second amplitude notch, adjacent (in frequency) to said amplitude spike.

27. The method of claim 17, further including the step of generating said spatially disorienting stimulus signal using a digital audio processing apparatus.

28. The method of claim 17, further including the step of generating said reorienting stimulus signal using a digital audio processing apparatus.

29. The method of claim 17, wherein said spatially disorienting stimulus signal is present at least about 2 seconds before said spatially reorienting stimulus signal is present.

30. The method of claim 17, wherein said spatially disorienting stimulus signal is present at least about 0.5 seconds after said spatially reorienting stimulus signal terminates.

31. The method of claim 17, wherein said original audio signal comprises any portion of a pre-existing audio recording.

32. The method of claim 17, wherein said original audio signal comprises any portion of a motion picture soundtrack.

33. The method of claim 17, wherein said original audio signal comprises electronically synthesized sounds.

34. The method of claim 17, wherein said original audio signal comprises any portion of a live sound performance, and wherein said combining steps occur during said live sound performance.

35. An apparatus for producing one or more three-dimensional audiospatial effects in an original audio signal, comprising:

means for generating a noise signal having one or more amplitude variations at selected frequencies, said frequencies and amplitude variations being selected so as to yield the desired three-dimensional audiospatial effects; and means for applying said noise signal to said original audio signal and thereby producing the desired three-dimensional audiospatial effects.

36. The apparatus of claim 35, wherein said noise signal comprises a modified white noise signal.

37. The apparatus of claim 36, wherein said modified white noise signal comprises a white noise pattern in which frequencies below about 4,000 Hz are emphasized.

38. The apparatus of claim 36, wherein said modified white noise signal comprises a white noise pattern in which frequencies above about 4,000 Hz are deemphasized.

39. The apparatus of claim 35, wherein said amplitude variations comprise one or more amplitude spikes in said noise signal.

40. The apparatus of claim 35, wherein said amplitude variations comprise one or more amplitude notches in said noise signal.

41. The apparatus of claim 35, wherein said amplitude variations comprise a first amplitude spike in said noise signal, an amplitude notch adjacent (in frequency) to said first amplitude spike, and a second amplitude spike, adjacent (in frequency) to said amplitude notch.

42. The apparatus of claim 35, wherein said amplitude variations comprise a first amplitude notch in said noise signal, an amplitude spike adjacent (in frequency) to said first amplitude notch, and a second amplitude notch, adjacent (in frequency) to said amplitude spike.

43. The apparatus of claim 35, further comprising a digital audio processor.

44. The apparatus of claim 35, wherein said means for applying said effect template to said original audio signal comprises a digital audio processor.

45. The apparatus of claim 35, wherein said original audio signal comprises any portion of a pre-existing audio recording.

46. The apparatus of claim 35, wherein said original audio signal comprises any portion of a motion picture soundtrack.

47. The apparatus of claim 35, wherein said original audio signal comprises electronically synthesized sounds.

48. The apparatus of claim 35, wherein said original audio signal comprises any portion of a live sound performance, and wherein said means for applying said effect template is operative during said live sound performance.

49. An apparatus for producing audiospatial effects in an original audio signal, comprising:

means for combining a spatially disorienting stimulus signal comprising a noise signal with said original audio signal; and means for combining a spatially reorienting stimulus signal with said original audio signal during a period in which said spatially disorienting stimulus signal is present.

50. The apparatus of claim 49, wherein said spatially disorienting stimulus signal and said spatially reorienting stimulus signal are components of a single signal.

51. The apparatus of claim 49, wherein said noise signal comprises a modified white noise signal.

52. The apparatus of claim 51, wherein said modified white noise signal comprises a white noise pattern in which frequencies below about 4,000 Hz are emphasized.

53. The apparatus of claim 51, wherein said modified white noise signal comprises a white noise pattern in which frequencies above about 4,000 Hz are deemphasized.

54. The apparatus of claim 49, wherein said spatially reorienting stimulus signal comprises a noise signal having one or more amplitude variations introduced at selected frequencies.

55. The apparatus of claim 54, wherein said amplitude variations include one or more amplitude spikes.

56. The apparatus of claim 54, wherein said amplitude variations include one or more amplitude notches.

57. The apparatus of claim 54, wherein said amplitude variations comprise a first amplitude spike in said noise signal, an amplitude notch adjacent (in frequency) to said first amplitude spike, and a second amplitude spike, adjacent (in frequency) to said amplitude notch.

58. The apparatus of claim 54, wherein said amplitude variations comprise a first amplitude notch in said noise signal, an amplitude spike adjacent (in frequency) to said first amplitude notch, and a second amplitude notch, adjacent (in frequency) to said amplitude spike.

59. The apparatus of claim 49, further including a digital audio processing device for generating said spatially disorienting stimulus signal.

60. The apparatus of claim 49, wherein said spatially disorienting stimulus signal is present at least about 2 seconds before said spatially reorienting stimulus signal is present.

61. The apparatus of claim 49, wherein said spatially disorienting stimulus signal is present at least about 0.5 seconds after said spatially disorienting stimulus signal terminates.

62. The apparatus of claim 49, wherein said original audio signal comprises any portion of a pre-existing audio recording.

63. The apparatus of claim 49, wherein said original audio signal comprises any portion of a motion picture soundtrack.

64. The apparatus of claim 49, wherein said original audio signal comprises electronically synthesized sounds.

65. The apparatus of claim 49, wherein said original audio signal comprises any portion of a live sound performance, and wherein said means for combining are operative during said live sound performance.

* * * * *